US008371928B2

(12) United States Patent
Englman et al.

(10) Patent No.: US 8,371,928 B2
(45) Date of Patent: Feb. 12, 2013

(54) GAMING SYSTEM HAVING REVEALED MYSTERY SYMBOLS

(75) Inventors: Allon G. Englman, Chicago, IL (US); Jamie W. Vann, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 473 days.

(21) Appl. No.: 12/665,255

(22) PCT Filed: Jun. 23, 2008

(86) PCT No.: PCT/US2008/007787

§ 371 (c)(1),
(2), (4) Date: Dec. 17, 2009

(87) PCT Pub. No.: WO2009/005618

PCT Pub. Date: Jan. 8, 2009

(65) Prior Publication Data

US 2010/0210343 A1 Aug. 19, 2010

Related U.S. Application Data

(60) Provisional application No. 60/937,816, filed on Jun. 29, 2007.

(51) Int. Cl.
*A63F 9/24* (2006.01)

(52) U.S. Cl. ..... 463/20

(58) Field of Classification Search ..... 463/20
See application file for complete search history.

(56) References Cited

U.S. PATENT DOCUMENTS 4,826,169 A 5/1989 Bessho et al.
6,190,254 B1 2/2001 Bennett
6,190,255 B1 * 2/2001 Thomas et al. ..... 463/20
6,676,512 B2 1/2004 Fong et al.
7,029,396 B2 * 4/2006 Jaffe et al. ..... 463/20

(Continued)

FOREIGN PATENT DOCUMENTS

WO WO 01/89646 11/2001
WO WO 01/89647 11/2001
WO WO 2009/005618 1/2009

OTHER PUBLICATIONS

Written Opinion corresponding to co-pending International Patent Application Serial No. PCT/US2008/007787, European Patent Office; dated Oct. 1, 2008; 5 pages.

(Continued)

*Primary Examiner* — Dmitry Suhol
*Assistant Examiner* — Carl V Larsen
(74) *Attorney, Agent, or Firm* — Nixon Peabody LLP

(57) ABSTRACT

A method for conducting a wagering game comprises receiving a wager and displaying a randomly selected outcome, the randomly selected outcome comprising a plurality of symbols arranged in an array. The array comprises a plurality of symbol positions, the plurality of symbols occupying the symbol positions. Each of the plurality of symbols is selected from a set of available symbols, the set of available symbols including a plurality of standard symbols and at least one mystery symbol. The method further comprises detecting the presence of the at least one mystery symbol in at least one of the symbol positions in the array and randomly selecting one replacement symbol from the plurality of standard symbols. The method further comprises replacing all occurrences of the at least one mystery symbol in the array with the replacement symbol to create a modified array and evaluating the modified array for winning combinations of standard symbols in accordance with a pay table of the wagering game.

21 Claims, 12 Drawing Sheets

U.S. PATENT DOCUMENTS

| | | | | |
|---|---|---|---|---|
| 2003/0069063 | A1 | 4/2003 | Bilyeu et al. | |
| 2004/0178574 | A1* | 9/2004 | Pierce et al. | 273/139 |
| 2004/0242312 | A1* | 12/2004 | Gomez et al. | 463/20 |
| 2008/0214292 | A1* | 9/2008 | Bryant et al. | 463/25 |
| 2008/0220852 | A1* | 9/2008 | Olive | 463/21 |
| 2008/0234033 | A1* | 9/2008 | Berman et al. | 463/20 |

OTHER PUBLICATIONS

International Search Report corresponding to co-pending International Patent Application Serial No. PCT/US2008/007787, European Patent Office; dated Oct. 1, 2008; 2 pages.

* cited by examiner

GAMING SYSTEM HAVING REVEALED MYSTERY SYMBOLS

CROSS REFERENCE TO RELATED APPLICATIONS

This application is a U.S. national stage filing of International Application No. PCT/2008/007787, filed Jun. 23, 2008, claiming priority from U.S. Provisional Application No. 60/937,816, filed Jun. 29, 2007, which are both incorporated herein by reference in their entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to a gaming system having revealed mystery symbols.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming systems with new types of bonus games to satisfy the demands of players and operators.

Traditionally, gaming machines display randomly selected outcomes of symbols and award players for winning combinations of symbols in accordance with a pay table. Other gaming machines have employed "clumping" of symbols, where groups or "clumps" of the same symbol appear adjacent to one another on vertical reels. The clumped symbols increase the likelihood of achieving a winning outcome and corresponding award. One problem that arises is that given the increased likelihood of a winning outcome, the clumped symbols often correspond to relatively lower awards on the pay table. Another problem exists in that if symbols corresponding to higher awards are clumped, the frequency of the occurrence of such clumped symbols is reduced to maintain a predetermined level or range of payout percentage. In other words, given the increased likelihood of greater awards, the frequency of such a result is reduced, thereby reducing enjoyment of the wagering game. Yet another problem that arises is that regardless of whether clumped symbols are used or not, as the randomly selected outcome is revealed to the player, enjoyment and anticipation are brief given the immediate perception of whether or not a winning outcome has been achieved, and if so, which symbols are involved in the winning outcome is and how it is awarded. The present invention is directed to solving these and other problems.

SUMMARY OF THE INVENTION

According to one aspect of the present invention, a method for conducting a wagering game comprises receiving a wager and displaying a randomly selected outcome, the randomly selected outcome comprising a plurality of symbols arranged in an array. The array comprises a plurality of symbol positions, the plurality of symbols occupying the symbol positions. Each of the plurality of symbols is selected from a set of available symbols, the set of available symbols including a plurality of standard symbols and at least one mystery symbol. The method further comprises detecting the presence of the at least one mystery symbol in at least one of the symbol positions in the array and randomly selecting one replacement symbol from the plurality of standard symbols. The method further comprises replacing all occurrences of the at least one mystery symbol in the array with the replacement symbol to create a modified array and evaluating the modified array for winning combinations of standard symbols in accordance with a pay table of the wagering game.

According to another aspect of the invention, a gaming system comprises a wager input device and a display for displaying a randomly selected outcome, the randomly selected outcome comprising a plurality of symbols arranged in an array. The array comprises a plurality of symbol positions, the plurality of symbols occupying the symbol positions. Each of the plurality of symbols is selected from a set of available symbols, the set of available symbols including a plurality of standard symbols and at least one mystery symbol. The system further includes a controller operative to (i) detect the presence of the at least one mystery symbol in at least one of the symbol positions in the array, (ii) randomly select one replacement symbol from the plurality of standard symbols, (iii) replace all occurrences of the at least one mystery symbol in the array with the replacement symbol to create a modified array, and (iv) evaluate the modified array for winning combinations of standard symbols in accordance with a pay table of the wagering game.

According to yet another aspect of the invention, a method for conducting a wagering game comprises receiving a primary wager and displaying a randomly selected outcome, the randomly selected outcome comprising a plurality of symbols arranged in an array. The array comprises a plurality of symbol positions, the plurality of symbols occupying the symbol positions. Each of the plurality of symbols is selected from a set of available symbols, the set of available symbols including a plurality of standard symbols and at least one mystery symbol. The method further comprises detecting the presence of the at least one mystery symbol in at least one of the symbol positions in the array and verifying that an eligibility requirement has been satisfied, and if so, replacing all of the standard symbols in the array with randomly selected symbols from the set of available symbols. The method further comprises randomly selecting one replacement symbol from the plurality of standard symbols and replacing all occurrences of the at least one mystery symbol in the array with the replacement symbol to create a modified array. The method further comprises evaluating the modified array for winning combinations of standard symbols in accordance with a pay table of the wagering game.

According to yet another aspect of the invention, a method for conducting a wagering game comprises receiving a wager and displaying a randomly selected outcome, the randomly selected outcome comprising a plurality of symbols arranged in an array. The array comprises a plurality of symbol positions, the plurality of symbols occupying the symbol positions. Each of the plurality of symbols is selected from a set of available symbols, the set of available symbols including a plurality of standard symbols and at least one mystery symbol. The mystery symbol having a special functionality. The method further comprises detecting the presence of the at least one mystery symbol in at least one of the symbol positions in the array and randomly selecting a first symbol from the plurality of standard symbols. The method further comprises replacing all occurrences of the first symbol in the array with a replacement symbol to create a modified array, wherein the replacement symbol has the same functionality as the mystery symbol.

According to yet another aspect of the invention, a computer readable storage medium is encoded with instructions for directing a gaming system to perform the above methods.

Additional aspects of the invention will be apparent to those of ordinary skill in the art in view of the detailed description of various embodiments, which is made with reference to the drawings, a brief description of which is provided below.

DETAILED DESCRIPTION

Figure 1A:
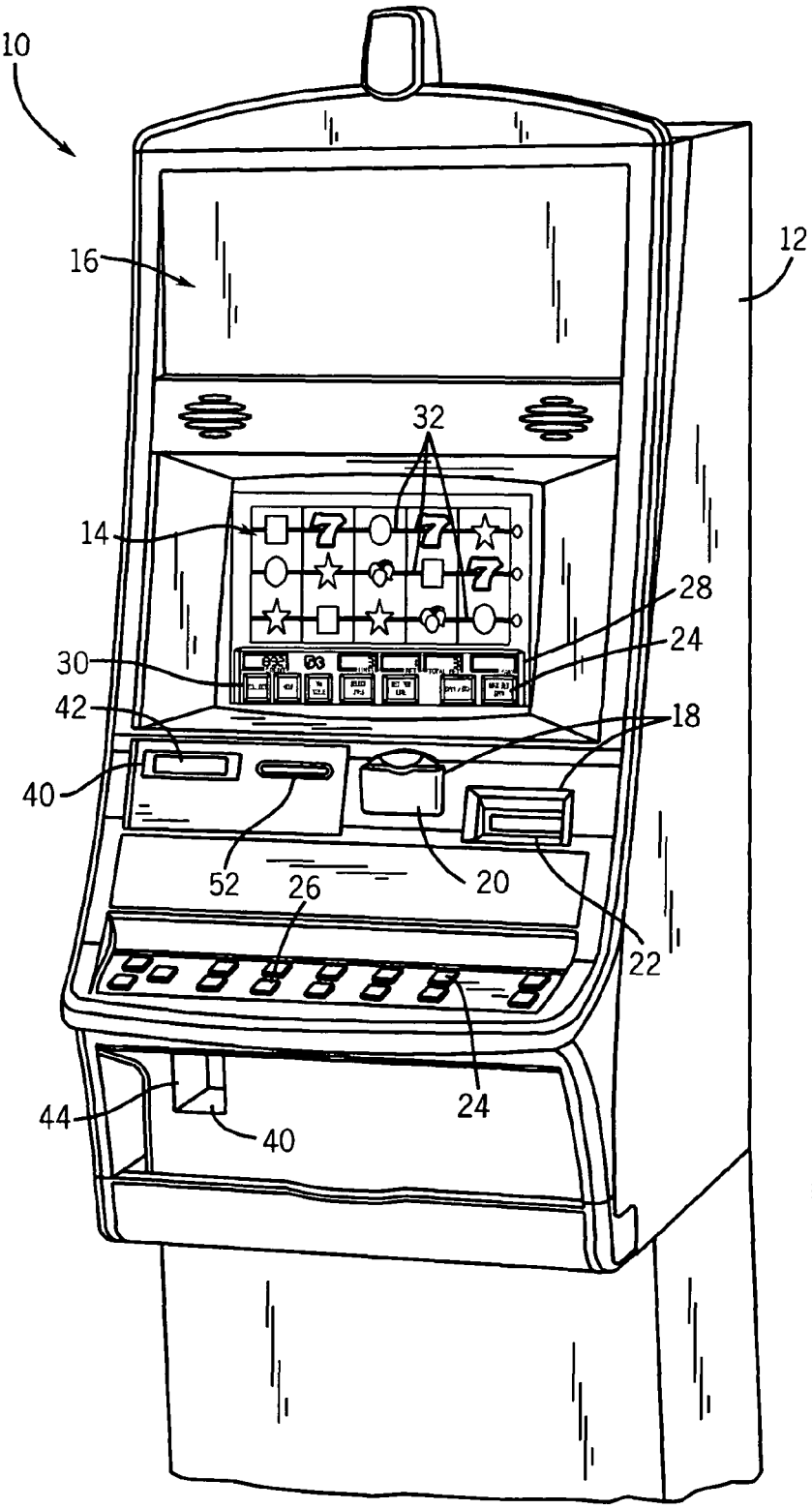
FIG. 1*a* is a perspective view of a free standing gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1*a*, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1*a*). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel.

The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1*a*, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. Alternatively, the primary display 14 of the gaming machine 10 may include a number of mechanical reels to display the outcome in visual association with at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1*a* as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
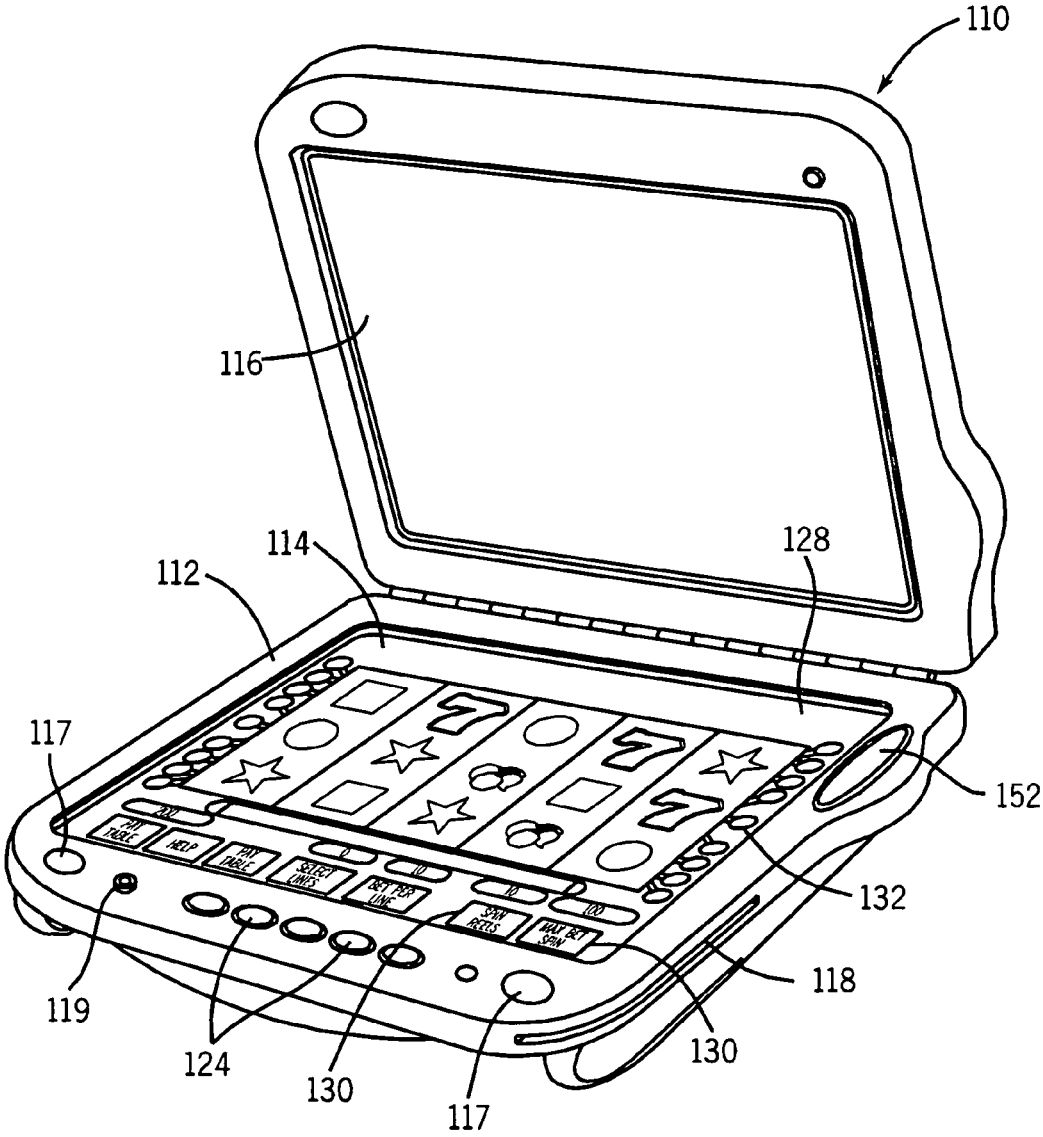
FIG. 1*b* is a perspective view of a handheld gaming machine embodying the present invention.

Depicted in FIG. 1*b* is a handheld or mobile gaming machine 110. Like the free standing gaming machine 10, the handheld gaming machine 110 is preferably an electronic gaming machine configured to play a video casino game such as, but not limited to, blackjack, slots, keno, poker, blackjack, and roulette. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons on a button panel for operating the handheld gaming machine 110. In addition, or alternatively, the player input device 124 may comprise a touch screen mounted to a primary display 114 and/or secondary display 116. In one aspect, the touch screen is matched to a display screen having one or more selectable touch keys 130 selectable by a user's touching of the associated area of the screen using a finger or a tool, such as a stylus pointer. A player enables a desired function either by touching the touch screen at an appropriate touch key 130 or by pressing an appropriate push button 126 on the button panel. The touch keys 130 may be used to implement the same functions as push buttons 126. Alternatively, the push buttons may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably takes the form of a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 18 or an assignment of credits stored on the handheld gaming machine via the touch screen keys 130, player input device 124, or buttons 126) on the handheld gaming machine 110. In at least some aspects, the basic game may comprise a plurality of symbols arranged in an array, and includes at least one payline 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1*b*, comprises a biometric sensing device.

Figure 2:
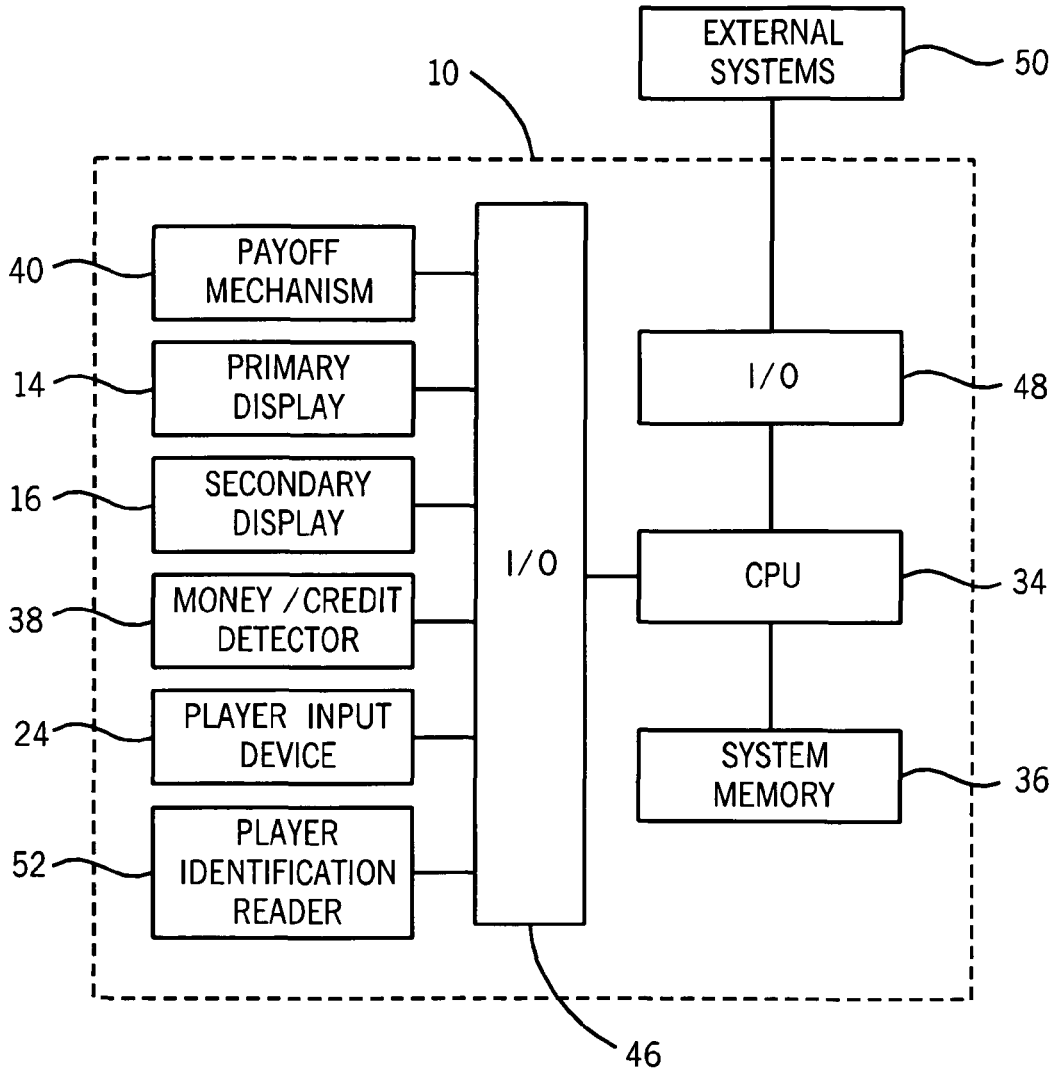
FIG. 2 is a block diagram of a control system suitable for operating the gaming machines of FIGS. 1*a* and 1*b;*

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1*a*, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10. The control system for a handheld gaming machine 110 may be similar to the control system for the free standing gaming machine 10 except that the functionality of the respective on-board controllers may vary.

The gaming machines 10,110 may communicate with external systems 50 (in a wired or wireless manner) such that each machine operates as a "thin client," having relatively less functionality, a "thick client," having relatively more functionality, or through any range of functionality there between. As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display(s) of the machine. In an alternative "thicker client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10,110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

Figure 3:
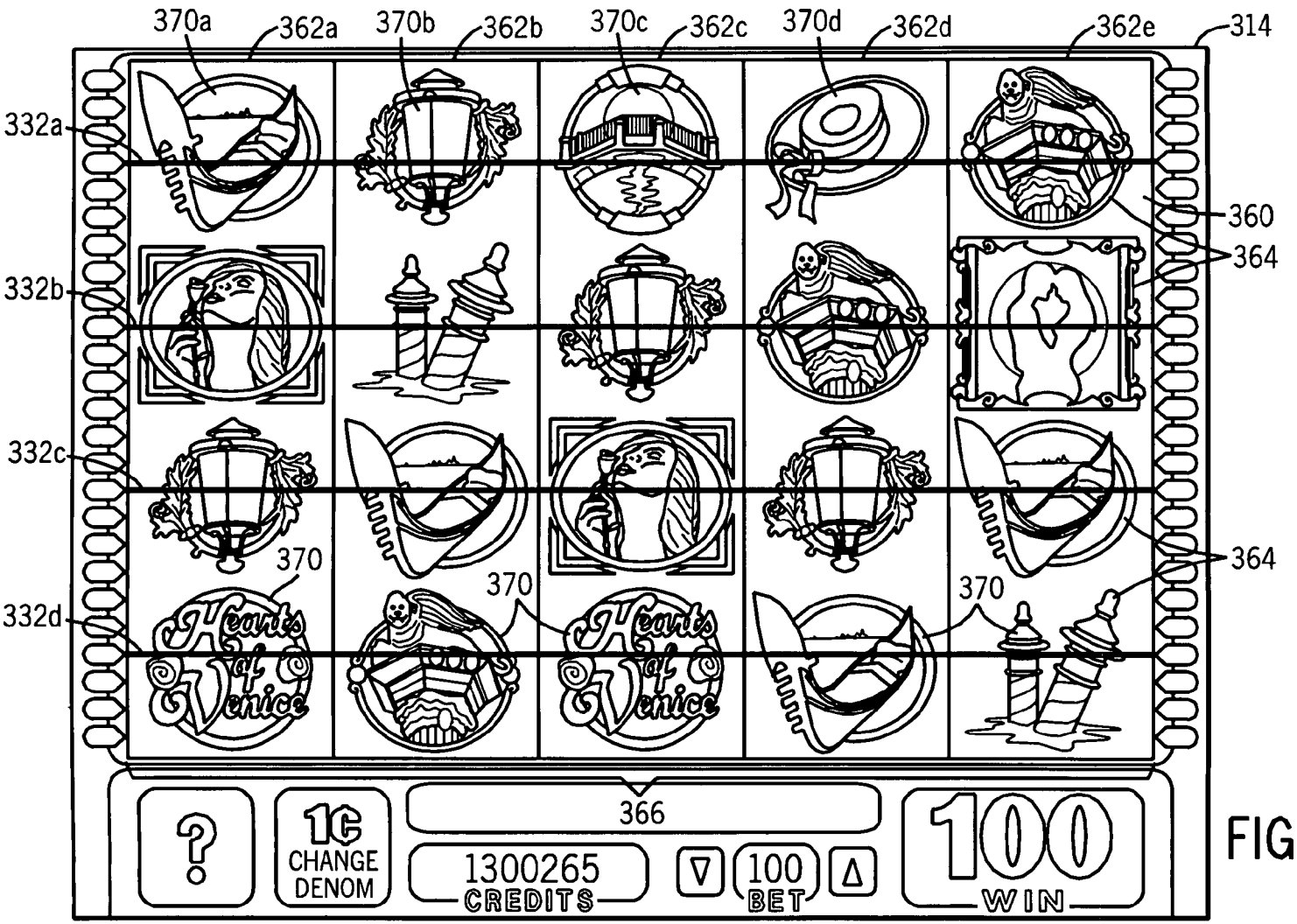
FIG. 3 is a screen shot of a primary display of the gaming system depicting a wagering game.

Turning now to FIG. 3, a primary display 314 of a gaming system is shown. The primary display 314 displays a primary wagering game 360 which includes a plurality of reels 362*a,b,c,d,e* which may be either electro-mechanical reels or simulations thereof on the primary display 314. The reels 362*a,b,c,d,e* include a plurality of symbols 364 displayed thereon which vary as the reels 362*a,b,c,d,e* are spun and stopped. The symbols 364 may include any variety of graphical symbols, elements, or representations, including symbols 364 which are associated with one or more themes of the gaming machine or system. The symbols 364 may also include a blank symbol, or empty space. As described herein the symbols 364 landing on the active paylines 332*a,b,c,d* (the paylines for which a wager has been received) are evaluated for winning combinations. If a winning combination of symbols 364 lands on an active payline 332*a,b,c,d*, a primary award is awarded in accordance with a pay table of the gaming device. The symbols 364 on the reels 362*a,b,c,d,e* form an array 336 or matrix of symbols 364, having a number of rows and columns, which in the embodiment shown is four rows and five columns. In alternate embodiments, the array 366 may have greater or fewer symbols 364, and may take on a variety of different forms having greater or fewer rows and/or columns. The array 366 may even comprise other non-rectangular forms or arrangements of symbols 364.

The symbols 364 which populate the array 366 are chosen from a set of available symbols. The set of available symbols includes a plurality of standard symbols 370, and at least one mystery symbol 372. Some of the standard symbols 370 are shown in FIG. 3, and include a boat symbol 370*a*, a street lamp symbol 370*b*, a bridge symbol 370*c*, a hat symbol 370*d*, etc. All of the symbols 364 shown in the array 366 in FIG. 3 are standard symbols 370. The standard symbols 370 are symbols which form winning combinations for which prizes are awarded. In other words, the standard symbols 370 appear in a pay table of the wagering game 360. In the embodiment shown, winning combinations of symbols include three or more like standard symbols 370 adjacent one another on an active pay line 332*a,b,c,d*. Thus, for example, three boat symbols 370*a* next to one another on an active pay line 332*a,b,c,d* would constitute a winning combination, and in accordance with a pay table of the wagering game 360, a prize would be awarded to a player if that randomly selected outcome is achieved.

Figure 4:
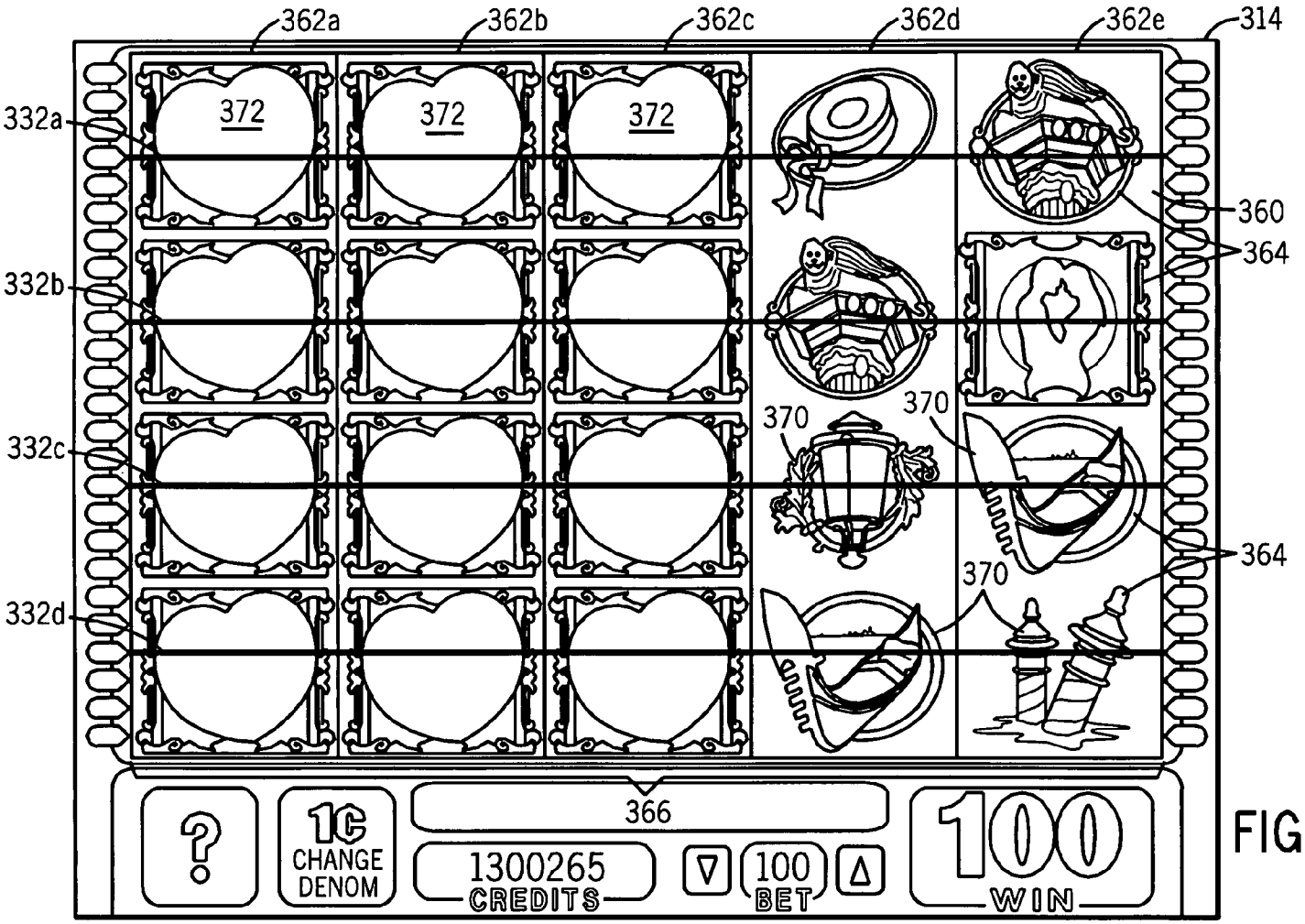
FIG. 4 is a further screen shot of the wagering game depicting at least one mystery symbol.

The set of available symbols 364 further includes at least one mystery symbol 372 as seen in FIG. 4. In this embodiment, the heart symbol 372 is a mystery symbol 372 included in the set of available symbols 364. In an embodiment, unlike the standard symbols 370, the mystery symbol 372 does not form or participate in winning outcomes, and does not appear in the pay table of the wagering game 360. In other words, the mystery symbol 372 is not a symbol with which winning combinations are evaluated. Nor does the mystery symbol 372 appear in the pay table of the wagering game 360. Rather, the mystery symbol 372 acts as a "place holder" to reveal a standard symbol 370 as described herein, thereby adding excitement and anticipation to the wagering game 360. Stated differently, the symbols 364 in the array 366 are not evaluated for winning combinations while the mystery symbol 372 is present, rather only after the mystery symbol 372 has completed its place holder function and been replaced by a standard symbol 370.

In the embodiment shown in the FIGURES, the reels 362 may include grouped or "clumped" symbols 364, which are multiple adjacent occurrences of the same symbol 364. Thus, when the reels 362 are spun and stopped so as to reveal a randomly selected outcome, two or more vertically adjacent symbols 364 on any one reel 362 may be the same. The symbols 364 may be clumped in groups of two, three or even more symbols 364. Both the standard symbols 370 and the mystery symbol 372 may be clumped when the randomly selected outcome is presented. Thus, when clumping is employed, the reel strips of the various reels 362 are configured so as to have adjacent symbols 364 being the same. Thus when the reels 364 are randomly spun and stopped, the clumped symbols 364 may or may not be displayed. In alternative embodiments, there may be no clumping of symbols 364, or perhaps only some subset of the set of available symbols 364 are subject to clumping.

As seen in FIG. 4, a randomly selected outcome of the wagering game 360 is depicted. The reels 362*a,b,c,d,e* have been spun and stopped to reveal the randomly selected outcome. In this instance, the symbols 364 in the randomly selected outcome include a plurality of standard symbols 370, and multiple occurrences of the mystery symbol 372. In fact, on this play of the wagering game, the player has achieved "fully clumped" mystery symbols 372 on the first three reels 362*a,b,c*, such that those reels 362*a,b,c* display only mystery symbols 372 (fully occupying the column of the array 366 corresponding to that reel 362). As indicated previously, the randomly selected outcome displayed in FIG. 4 cannot yet be evaluated for winning combinations because the randomly selected outcome includes at least one occurrence of the mystery symbol 372. Thus, a controller (not shown) of the wagering game 360 detects the presence of any mystery symbols 372 in the resulting array 366 of the randomly selected outcome. If the controller detects at least one occurrence of the mystery symbol 372, further steps must be performed before the array 366 can be evaluated for winning outcomes or combinations of standard symbols 370. The controller recognizes that the mystery symbols 372 in the array 366 act as placeholder symbols for other standard symbols 370, and thus the controller must complete the process of replacing the mystery symbols 372.

Once the controller detects at least one occurrence of the mystery symbol 370 in the array 366, the controller selects as a replacement symbol 374 one of the standard symbols 370 of the wagering game 360. The replacement symbol 374 replaces all occurrences of the mystery symbol 372 in the array 366. The selection of the replacement symbol 374 may be random or may be according to some predetermined algorithm or method. Moreover, if random, the selection of the replacement symbol 374 may be in accordance with a weighted probability table, such that two or more of the standard symbols 370 have differing probabilities of being randomly selected as the replacement symbol 374. For example, in an embodiment, the standard symbols 370 for which winning combinations pay the highest or most in the pay table of the wagering game 360 may be assigned a relatively lower probability of being selected as the replacement symbol 374, while lower paying standard symbols 370 may be assigned relatively higher probabilities of being selected as replacement symbols 374. In the particular play of the wagering game 360 shown in FIGS. 4 and 5, the controller has selected the boat standard symbol 370*a* to be the replacement symbol 374.

Figure 5:
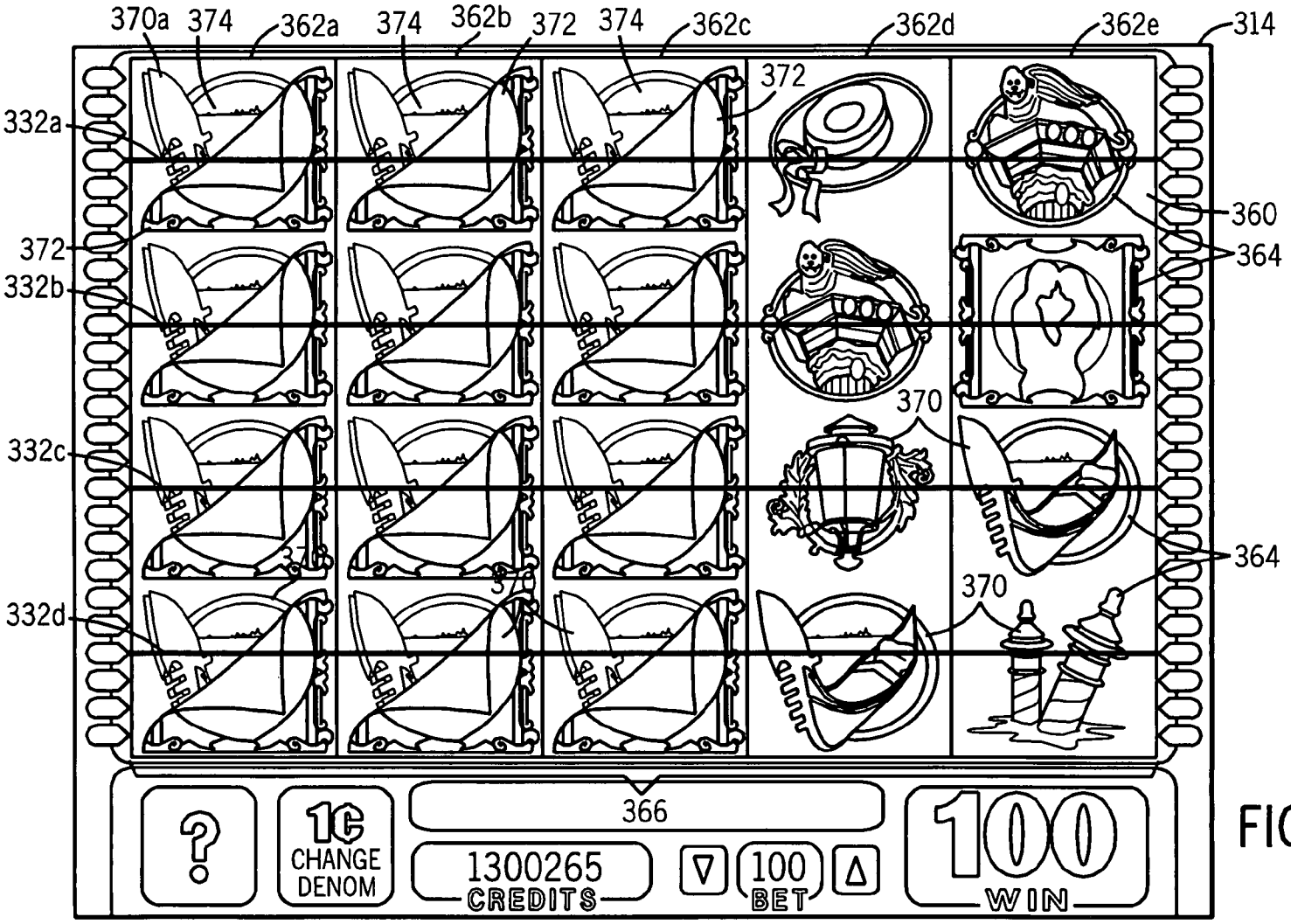
FIG. 5 is a further screen shot of the wagering game depicting the mystery symbols being removed and revealing underlying standard symbols.

As seen in FIG. 5, in one embodiment, the replacement symbol 374 is positioned underlying each occurrence of the mystery symbol 372 in the array 366. Once positioned, the mystery symbol 372 is removed to reveal the underlying replacement symbols 374 in each position previously occupied by the mystery symbol 372. In the embodiment shown in FIG. 5, the reveal is accomplished by graphically removing the mystery symbols 372 by "peeling them back" to reveal the underlying replacement symbols 374. In alternative embodiments, visually depicting the replacement of the mystery symbol 372 with the replacement symbol 374 can be accomplished in any number of ways. For example, the mystery symbols 372 could first be removed leaving blank spaces in the array 366 which are later filled by replacement symbols 374 that are animated so as to "fly" across the display 314 and into the proper positions. In yet another embodiment, the mystery symbols 372 could graphically be morphed or transformed into the resulting replacement symbols 374. Many graphical techniques could be used so as to visually depict the mystery symbols 372 revealing, changing into, or being replaced by the replacement symbols 374. The reveal or replacement may also be accompanied by other entertaining graphics, animations, and even other video displays, tactile outputs, and/or sound and audio performances.

Figure 6:
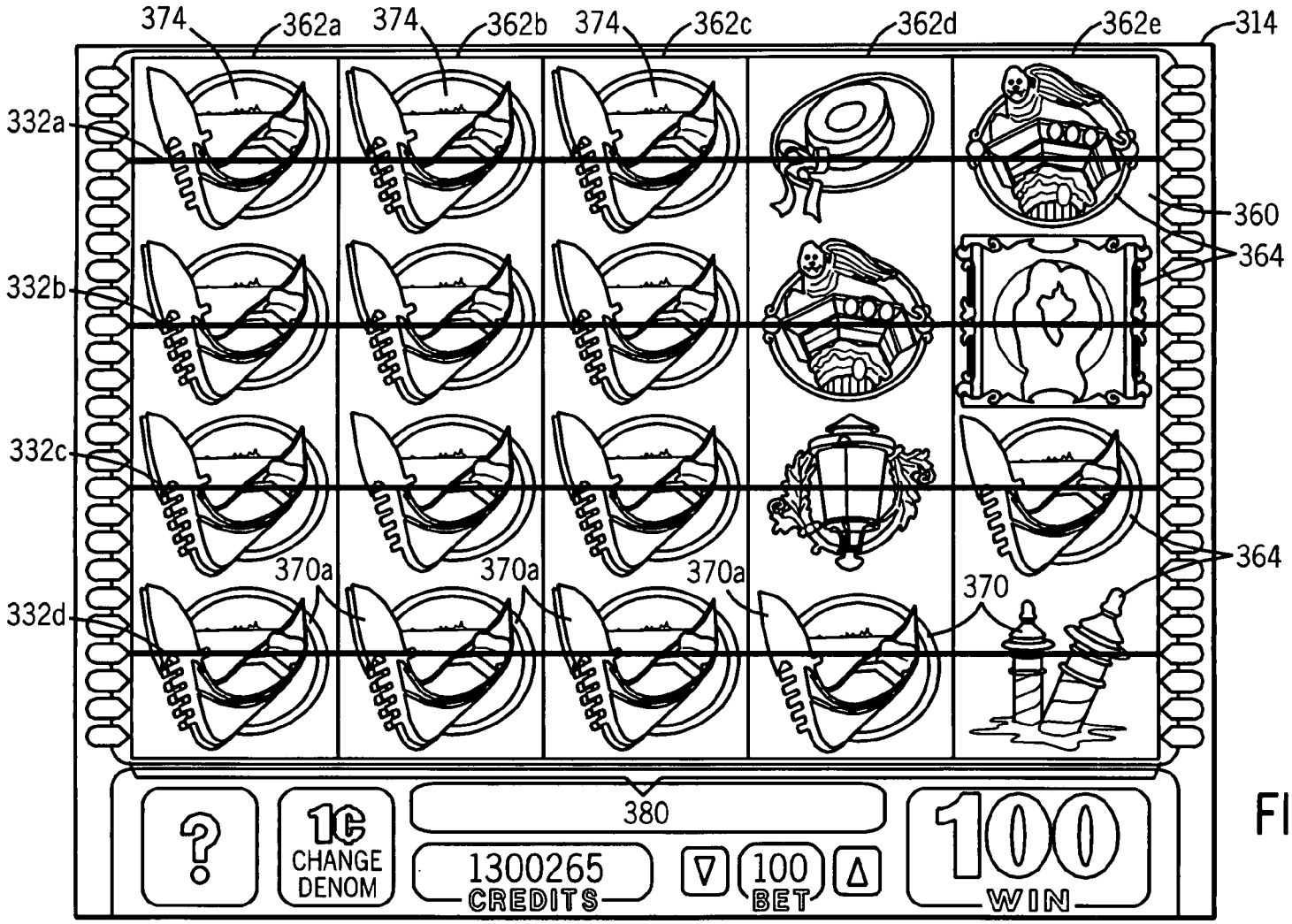
FIG. 6 is a further screen shot of the wagering game depicting the revealed standard symbols.

Turning to FIG. 6, once the mystery symbols 372 have been replaced by the replacement symbols 374, a modified array 380 is created and displayed. The modified array 380 comprises the original standard symbols 370 of the randomly selected outcome (as seen in FIG. 4), plus the replacement symbols 374. Thus, the modified array 380 contains only standard symbols 370 and has no mystery symbols 372 remaining. Thus, unlike the array 366, the modified array 380 may be, and is evaluated for winning combinations of standard symbols 370 along activated pay lines 332*a,b,c,d*. In the embodiment shown in FIG. 6, three or more boat symbols 370*a* have occurred on at least four active pay lines 332*a,b,c,d*, and thus the player is awarded a prize or award for each winning outcome on each of the four pay lines 332*a,b,c,d*. On the first two pay lines 332*a,b*, the player has achieved "three boat symbol" wins, while on the third and fourth pay lines 332*c,d*, the player has achieved "four boat symbol" wins, for which even higher awards are paid.

In this way, the wagering game 360 includes an entertaining "mystery symbol" feature which serves as a placeholder and adds to the excitement and anticipation of play. A player of the wagering game 360 is aware that three or more like standard symbols 370 on an active pay line 332*a,b,c,d* constitutes a winning combination for which an award is paid. However, since the player does not know which standard symbol 370 will be selected as the replacement symbol 374, the player awaits the reveal with extra enjoyment and heightened anticipation. In the example shown in FIGS. 4 and 5, when the player sees large groups of clumped mystery symbols 372 on the first three reels 362*a,b,c*, the player knows that he has achieved multiple winning combinations of one of the standard symbols 370, but does not know which one. The player is aware of this, as the player knows and is informed by the wagering game 360 so as to understand that mystery symbol 372 will be removed and replaced with multiple occurrences of the same standard symbol 370. Thus, the player eagerly awaits the controller's selection and revealing of the replacement symbol 374 to see what the player will be awarded. In the example shown, the player is aware that he has achieved two "three symbol" pays on the first two pay lines 332*a,b* and two "four symbol" pays on the last two pay lines 332*c,d*. Thus as the dramatic revealing of the replacement symbol 374 is occurring, the player eagerly hopes that the replacement symbol 374 will be one of the relatively higher paying standard symbols 370 as opposed to one of the relatively lower paying standard symbols 370. Regardless of which standard symbol 370 is chosen as the replacement symbol 374, the player gains comfort in knowing he has achieved four winning combinations, and greater excitement in the possibility of large payouts.

Figure 7:
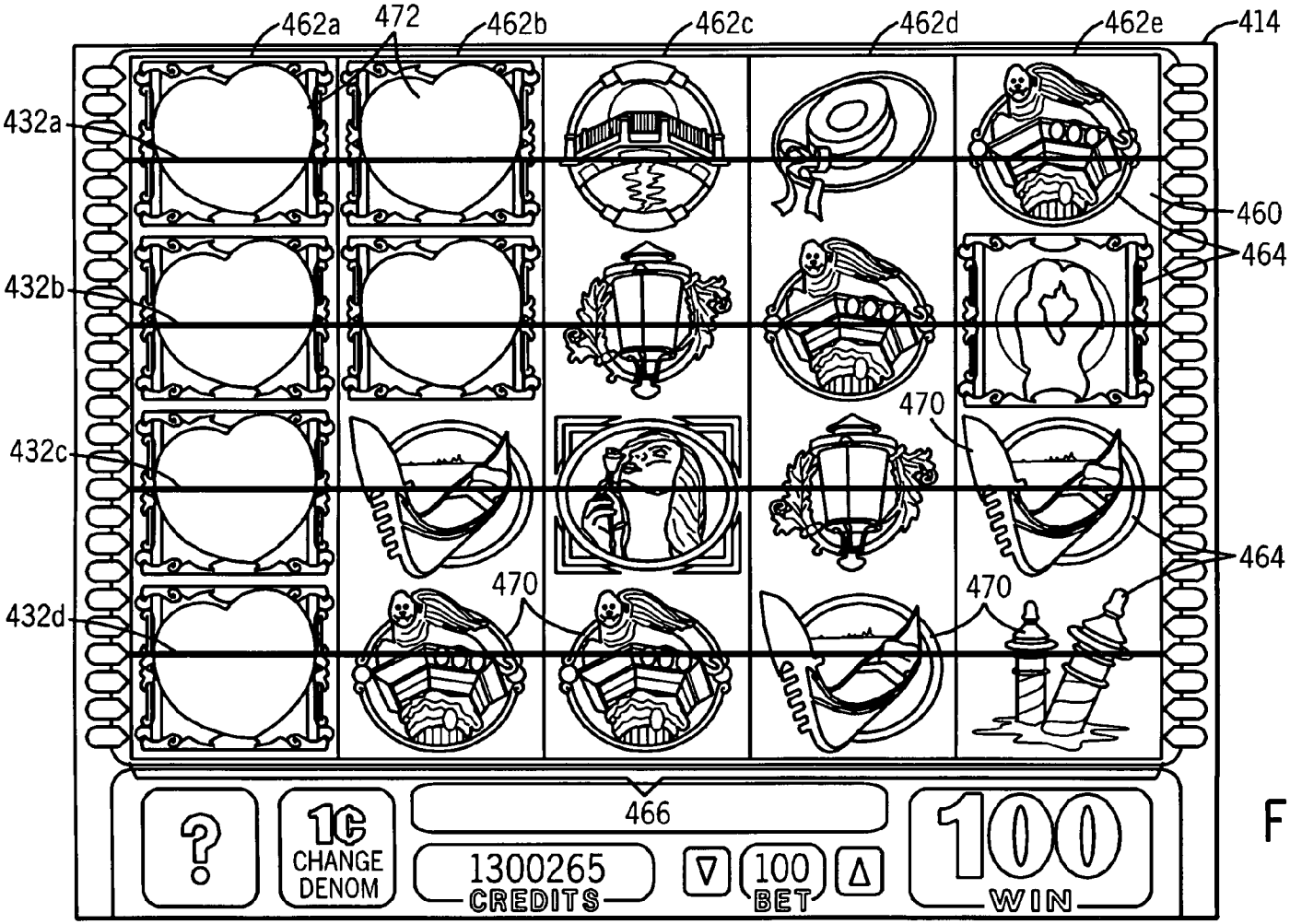
FIG. 7 is a screen shot of a wagering game including a re-spin feature.
Figure 8:
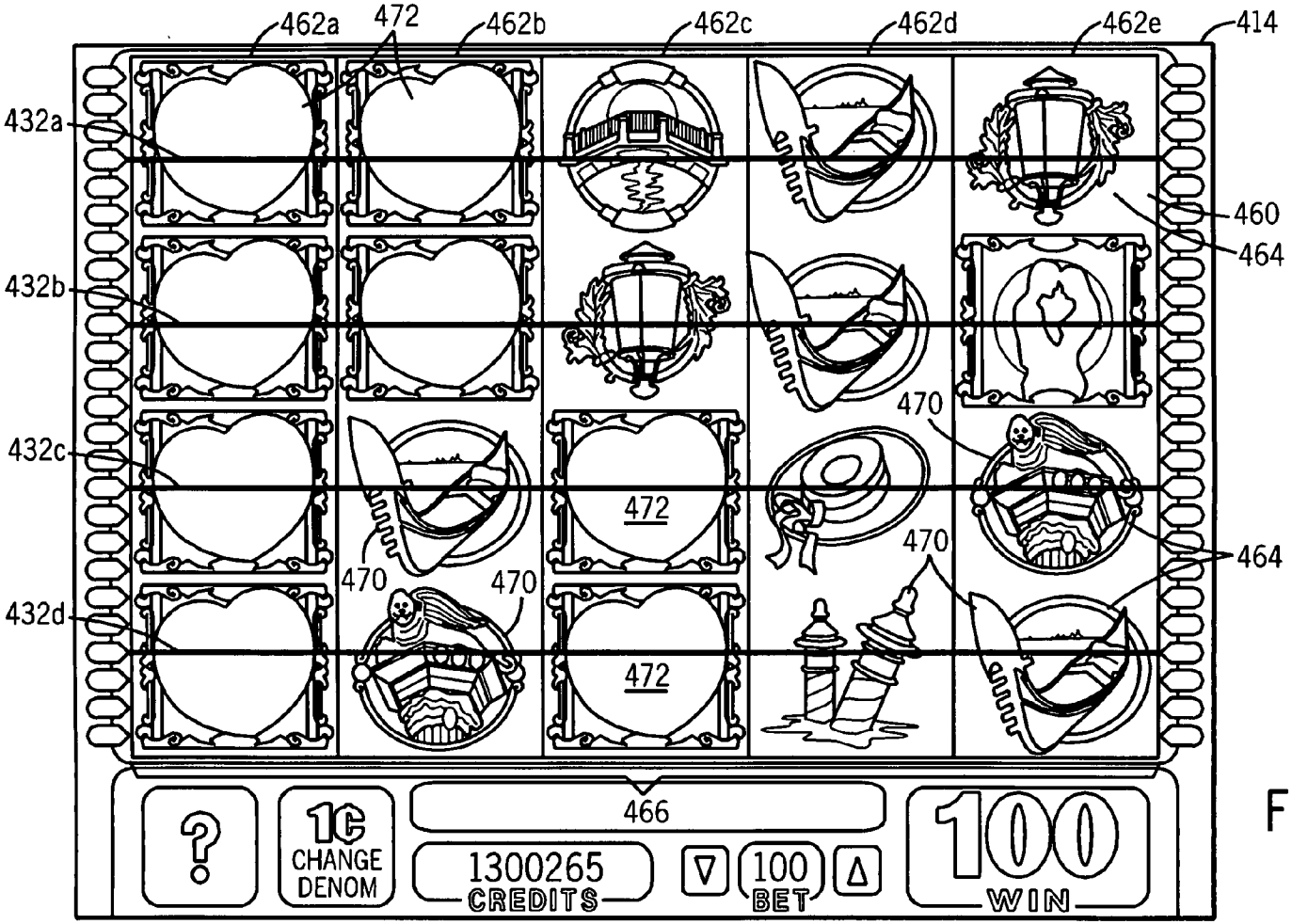
FIG. 8 is a screen shot of the wagering game of FIG. 7 following one activation of the re-spin feature.

An alternative embodiment of the wagering game 460 is depicted in FIGS. 7 and 8, which includes a re-spin feature. The wagering game 460 again comprises a plurality of symbols 464 randomly selected from a set of available symbols. The set of available symbols 464 includes standard symbols 470 and at least one mystery symbol 472. The randomly selected symbols 464 are displayed on a plurality of reels 462 so as to form an array 466 comprising a number of rows and columns. In FIG. 7, on another play of the wagering game 460, a different resulting randomly selected outcome has been displayed on the primary display 414. On this play of the game 460, the randomly selected outcome includes four clumped mystery symbols 472 on the first reel 462*a* and two clumped mystery symbols 474 on the second reel 462*b*. The remaining randomly selected symbols 464 in the array 466 are all standard symbols 370.

The controller (not shown) of the wagering game 460 evaluates a re-spin eligibility requirement to see if the eligibility requirement is satisfied. In the embodiment shown, the re-spin eligibility requirement comprises a predetermined arrangement of mystery symbols 472. The predetermined arrangement in this embodiment comprises the first reel 462*a* being fully clumped with mystery symbols 472 and the second reel 462*b* having at least one mystery symbol 472. Thus, in the randomly selected outcome shown in FIG. 7, the re-spin eligibility requirement is satisfied. Because the eligibility requirement is met, the re-spin feature of the wagering game 460 is activated and initiated. The re-spin feature involves replacing at least one of the standard symbols 470 in the array 466 with another randomly selected symbol 464, which could be either the same standard symbol 470, a different standard symbol 470, or the mystery symbol 472.

In the embodiment shown, because the eligibility requirement is met and evaluated on the first two reels 462*a,b*, the remaining three reels 462*c,d,e* are re-spun. Thus, the third, fourth and fifth reels 462*c,d,e* are re-spun and stopped to reveal different symbols 464, which may be either standard symbols 470 or mystery symbols 472. As seen in FIG. 8, the third reel 462*c* now includes two additional clumped mystery symbols 472 on the bottom two rows, such that the total number of mystery symbols 472 in the array 466 has been increased (from six to eight).

Thus, the re-spin feature serves to give the player a "second chance" to improve the randomly selected outcome by adding additional occurrences of the mystery symbol 472. In one embodiment, only reels 462 which have no occurrences of the mystery symbol 472 are re-spun so as to ensure that the number of mystery symbols 472 will either stay the same or go up after the re-spin, but not go down. In yet other alternative embodiments, other eligibility requirements may need to be satisfied in order for the re-spin feature to be executed. For example, the eligibility requirement may comprise predetermined patterns of symbols 464 in the array 466, minimum bet levels, minimum number of activated pay lines 432, time on device, placement of a secondary or side wager, etc.

Once the re-spin feature has been completed, then the remainder of the wagering game 460 plays out in similar fashion to the embodiment shown in FIGS. 3 through 6. The controller selects a replacement symbol 474, which is one of the standard symbols 470. The selected replacement symbol 474 replaces all occurrences of the mystery symbol 472 in the array 466 so as to create a modified array (not shown) which is then evaluated for winning combinations along activated pay lines 432. As before, the modified array comprises only standard symbols 470.

In alternative embodiments, the re-spin feature may be activated more than one time. For example, the re-spin feature may be activated each time an additional mystery symbol 472 is added to the array 466. Moreover, the re-spin feature may be limited to certain symbol positions or reels 462. For example, if the eligibility requirement is satisfied, less than all of the remaining reels 462 may be re-spun. In one embodiment, when the eligibility requirement is satisfied, only an adjacent reel 462 is re-spun. In alternative embodiments where the array 466 of symbols 464 does not include rotatable reels, it should be understood that the "re-spin" feature refers to an additional generation of randomly selected symbols 464 to fill the array 466. In other words, "re-spin" refers to the replacement of standard symbols 470 in the array 466, regardless of whether the symbols 464 in the array 466 are on reels 462 or not.

In the embodiments shown, the symbols of the array are varied as a function of being positioned on rotatable reels. However, in alternative embodiments, the symbols may be varied in other manners so as to present an array of randomly selected symbols. For example, each symbol position in the array may itself comprise an individual reel such that the symbols appearing within a single column or row of the array are not dependent upon one another. In yet another alternative embodiment, the symbols may "fall into" or cascade into the array, or enter the array from one of the sides of the array or the edges of the display. One such example of a cascading symbol game is described in U.S. Patent Application 2004/0033829 to Pacey et al, entitled "Symbol Matching Gaming Machine" and assigned to WMS Gaming Inc., which is hereby fully incorporated by reference as if fully set forth herein. In yet other alternative embodiments, many other techniques may be used to animate or present the array and modified array of the present invention to the player via the display.

Figure 9:
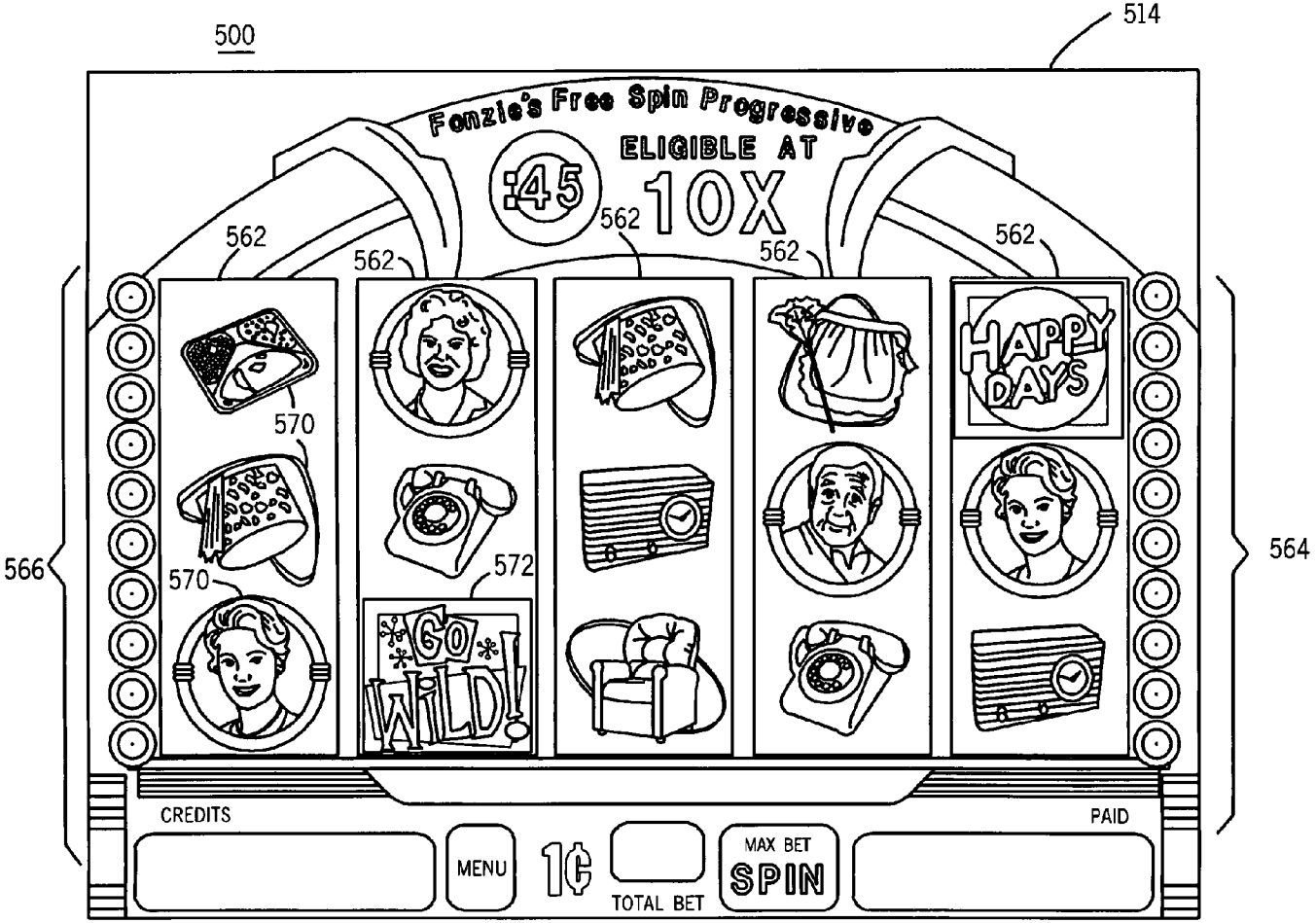
FIG. 9 is a screen shot of an alternate embodiment of a gaming system depicting a wagering game including a mystery symbol.
Figure 10:
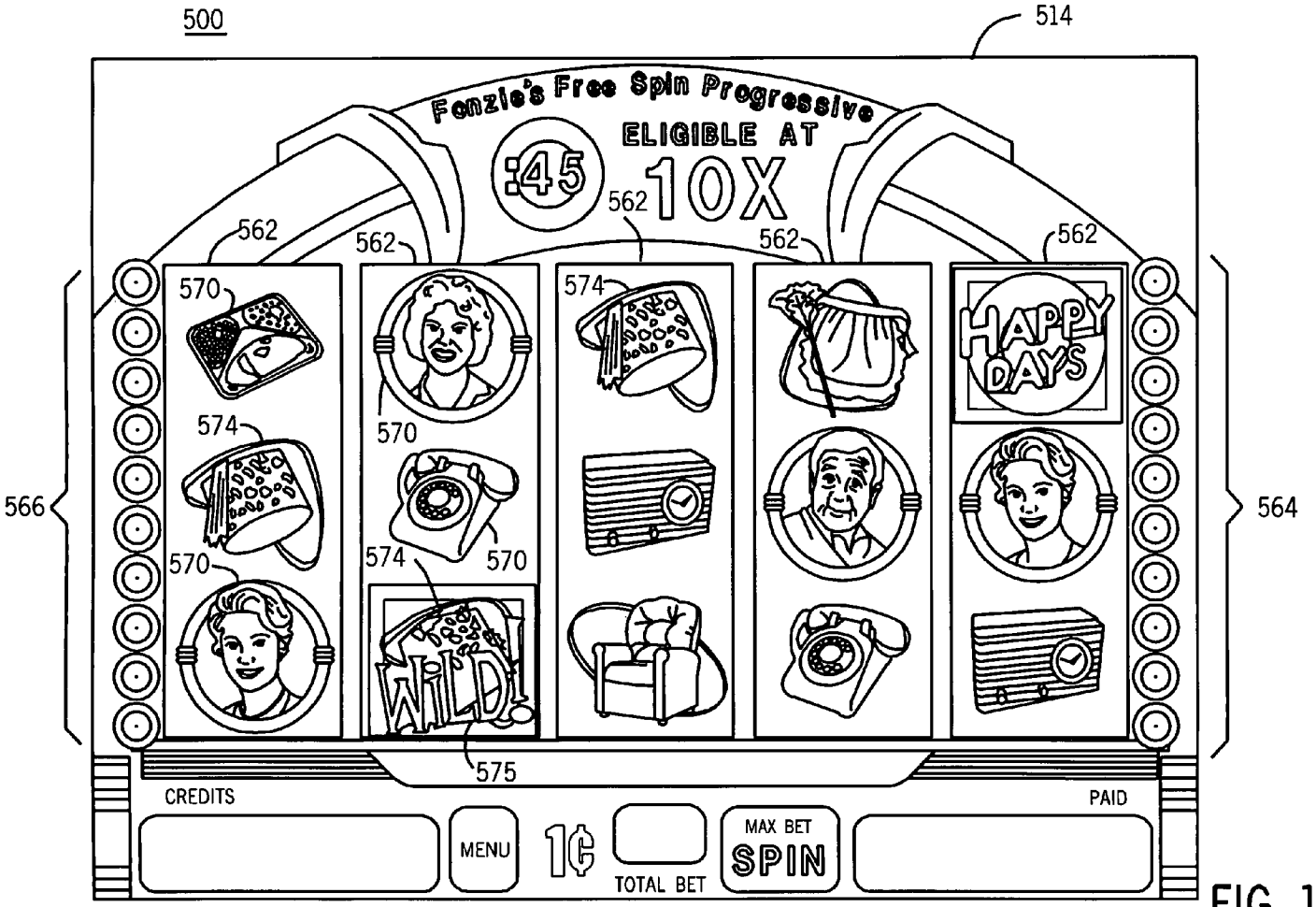
FIG. 10 is a further screen shot of the wagering game of FIG. 9, wherein the mystery symbol is revealed.
Figure 11:
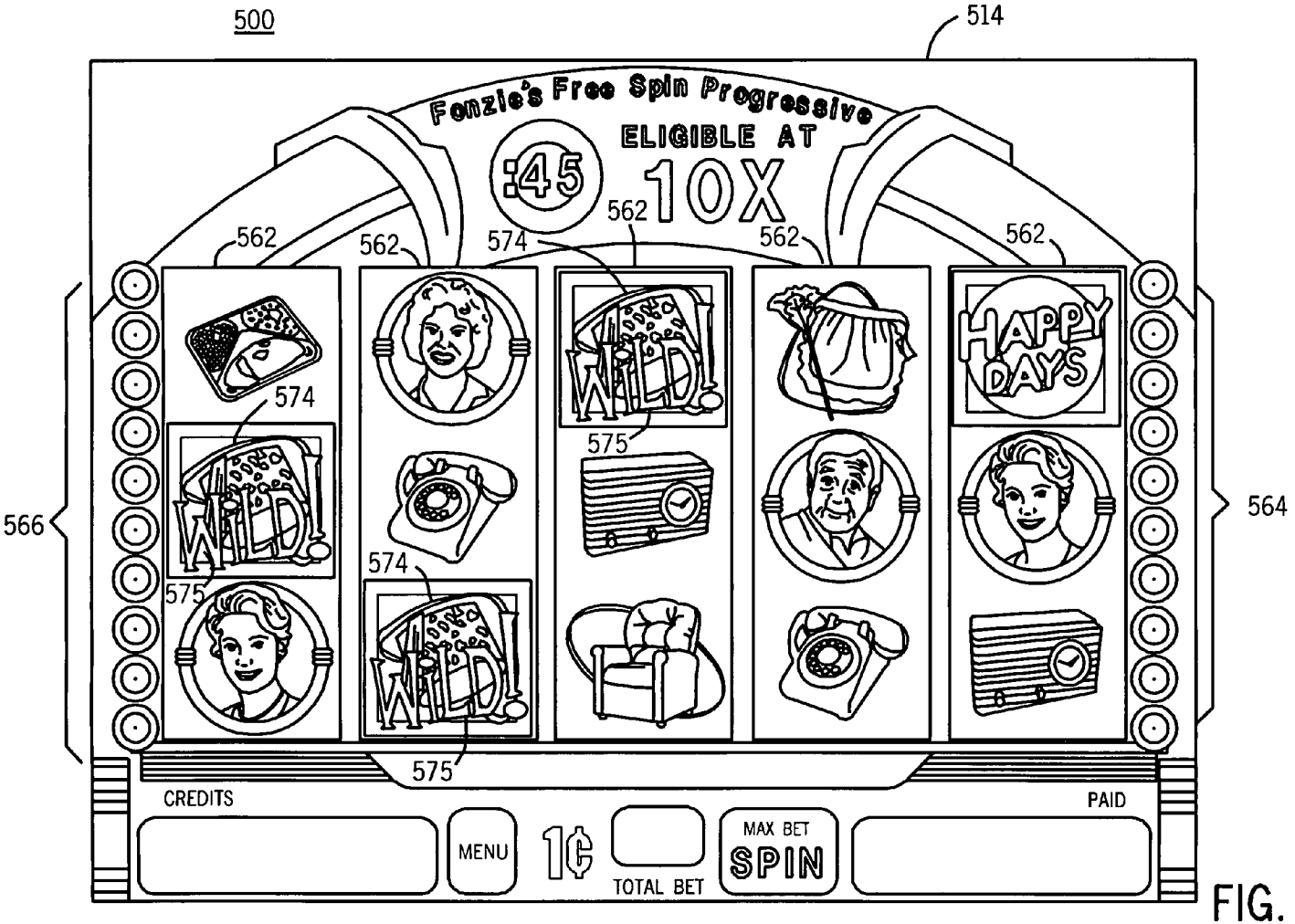
FIG. 11 is a further screen shot of the wagering game of FIG. 9, wherein a special functionality of the mystery symbol is copied to other like symbols.

An alternative embodiment of a gaming system 500 having a primary display 514 displaying a wagering game 560 is depicted in FIGS. 9-11. In FIG. 9, a wagering game 560 is displayed comprising a plurality of reels 562 having symbols 564 thereon. The symbols 564 are arranged in rows and columns forming a matrix or array 566. The symbols 564 in the array 566 are selected from a set of available symbols, which include a plurality of standard symbols 570 and at least one mystery symbol 572. As with other embodiments described herein, the standard symbols 570 form combinations which are evaluated on active paylines in accordance with a pay table of the gaming system 500, whereas at least one mystery symbol 572 participates in winning combinations only after it has been revealed. In FIG. 9, all of the symbols 564 are standard symbols 570 except for the "Go Wild" symbol which is a mystery symbol 572 in this embodiment. In this embodiment, in addition to being a mystery symbol 572, the "Go Wild" symbol has an additional or special functionality, and thus acts as a special symbol. In this case, as seen from the label, the "Go Wild" symbol carries the special functionality that it is a wild symbol which can replace any other symbol for purposes of evaluating winning combinations of symbols vis-à-vis the pay table. In other embodiments, the special functionality may take on different functions, such as the symbol acting as a scatter symbol (instead of, or in addition to being a line paying symbol), a multiplier, a multiplying wild symbol, an expanding wild symbol, a re-spin symbol, or a symbol upgrade.

Turning to FIG. 10, upon the occurrence of a triggering event, all occurrences of mystery symbols 572 are transformed so as to reveal a replacement symbol 574. In this embodiment, the triggering event is the occurrence of a mystery symbol 572 in the array 566. Thus, because at least one mystery symbol 572 has landed in the array 566, all occurrences of the mystery symbol 572 are transformed to reveal a replacement symbol 574. In other embodiments, various other triggering events may be used to cause the transformation of the mystery symbol 572 into a replacement symbol 574. In an embodiment, all occurrences of the mystery symbol 572 are transformed into the same replacement symbol 574. The replacement symbol 574 is selected from the set of standard symbols 570. In an embodiment, the replacement symbol 574 is randomly selected, but in alternative embodiments, the replacement symbol 574 may be predetermined, or selected in accordance with some algorithm or dependency.

As can be seen in FIG. 10, the replacement symbol 574 has been selected to be the "Cheetah Hat" symbol 574. Thus, the mystery symbol 572 is transformed into the "Cheetah Hat" replacement symbol 574 as seen with the symbol in the bottom row of the second column of the array 566. In an embodiment, the replacement symbol 574 may also carry a label 575 which serves to communicate the special functionality of the mystery symbol 572. The special functionality may continue with the replacement symbol 574 as seen in FIG. 10, and thus the label 575 conveys that information to a player or observer of the wagering game 560.

Looking at FIGS. 10 and 11, other occurrences of the selected replacement symbol 574 in the array 566 are transformed so as to receive the special functionality of the original mystery symbol 572. Thus, as can been seen in FIGS. 10 and 11, two other occurrences of the "Cheetah Hat" symbol 574 are present in the array 566 (middle row of the first column, and top row of the third column). These other occurrences of the "Cheetah Hat" symbol 574 are transformed so as to receive the "wild symbol" functionality of the mystery symbol 572. Therefore, in FIG. 11, to further communicate the functionality bestowed, the label 575 from the replacement symbol 574 is copied to the other two instances of the "Cheetah Hat" symbol 574, as is the "wild" functionality associated with the label 575. Therefore, in this embodiment, the mystery symbol 572 carries with it a special functionality, which is carried on or conveyed to the resulting replacement symbol 574, as well as to all other instances of the replacement symbol 574 occurring in the array 566.

In yet other alternative embodiments, a wide variety of special functions may be used in addition to, or instead of, the wild functionality displayed in FIGS. 9-11. For example, the special functionality of the mystery symbol 572 may be a multiplier, a wild multiplier, a scatter pay, a symbol upgrade, or any other special functionality not associated with the standard symbols 570. Moreover, it should be understood that a plurality of mystery symbols 572 may be utilized, as well as a plurality of replacement symbols 574. Instead of, or in addition to, the labels 575, other graphics, animations and/or audio/visual cues may be used to alert an observer as to the additional special functionality being conveyed from the transformed replacement symbol 574 to other occurrences of the replacement symbol 574 in the array.

Each of these embodiments and obvious variations thereof is contemplated as falling within the spirit and scope of the claimed invention, which is set forth in the following claims.

What is claimed is:

1. A method for conducting a wagering game, comprising:

receiving a wager via one or more wager input devices;

displaying a randomly selected outcome on one or more display devices, the randomly selected outcome comprising a plurality of symbols arranged in an array, the array comprising a plurality of symbol positions, the plurality of symbols occupying the symbol positions, each of the plurality of symbols selected from a set of available symbols, the set of available symbols including a plurality of standard symbols and at least one mystery symbol, the mystery symbol having a special functionality selected from a plurality of special functionalities and not included in any of the plurality of standard symbols;

detecting the presence of the at least one mystery symbol in at least one of the symbol positions in the array via one or more processors;

via the one or more processors, randomly selecting a first symbol from the plurality of standard symbols as a replacement symbol;

replacing all occurrences of the mystery symbol in the array with the replacement symbol to create a modified array via the one or more processors, wherein the replacement symbol has the same functionality as the mystery symbol; and providing the special functionality of the mystery symbol for all other occurrences of the first symbol in the plurality of symbols.

2. The method of claim 1, wherein the special functionality is selected from the group consisting of wild symbol, scatter symbol, multiplier, multiplying wild symbol, expanding wild symbol, re-spin symbol, and symbol upgrade symbol.

3. The method of claim 1, wherein the at least one mystery symbol includes a label associated with the special functionality.

4. The method of claim 3, wherein the label is copied to each of the replacement symbols in the modified array.

5. The method of claim 1, further comprising evaluating the modified array for winning combinations of symbols in accordance with a pay table of the wagering game and awarding a prize for any winning combinations of symbols in the modified array in accordance with the pay table.

6. The method of claim 1, wherein the plurality of symbols in the array are arranged on a plurality of rotatable reels.

7. The method of claim 1, wherein the array comprises N symbol positions, wherein the number of symbol positions occupied by the at least one mystery symbol is less than N.

8. A gaming system comprising:

a wager input device;

a display for displaying a randomly selected outcome, the randomly selected outcome comprising a plurality of symbols arranged in an array, the array comprising a plurality of symbol positions, the plurality of symbols occupying the symbol positions, each of the plurality of symbols selected from a set of available symbols, the set of available symbols including a plurality of standard symbols and at least one mystery symbol, the mystery symbol having a special functionality selected from a plurality of special functionalities and not included in any of the plurality of standard symbols; and a controller operative to:

(i) detect the presence of the at least one mystery symbol in at least one of the symbol positions in the array;

(ii) randomly select a first symbol from the plurality of standard symbols as a replacement symbol;

(iii) replace all occurrences of the mystery symbol in the array with the replacement symbol to create a modified array, wherein the replacement symbol has the same functionality as the mystery symbol; and (iv) provide the special functionality of the mystery symbol for all other occurrences of the first symbol in the plurality of symbols.

9. The gaming system of claim 8, wherein the special functionality is selected from the group consisting of wild symbol, scatter symbol, multiplier, multiplying wild symbol, expanding wild symbol, re-spin symbol, and symbol upgrade symbol.

10. The gaming system of claim 8, wherein the at least one mystery symbol includes a label associated with the special functionality.

11. The gaming system of claim 10, wherein the label is copied to each of the replacement symbols in the modified array.

12. The gaming system of claim 8, wherein the controller evaluates the modified array for winning combinations of symbols in accordance with a pay table of the wagering game and awarding a prize for any winning combinations of symbols in the modified array in accordance with the pay table.

13. The gaming system of claim 8, wherein the plurality of symbols in the array are arranged on a plurality of rotatable reels.

14. The gaming system of claim 8, wherein the array comprises N symbol positions, wherein the number of symbol positions occupied by the at least one mystery symbol is less than N.

15. A computer readable, non-transitory, storage medium encoded with instructions for directing a gaming system to perform the acts of:

displaying a randomly selected outcome on one or more display devices, the randomly selected outcome comprising a plurality of symbols arranged in an array, the array comprising a plurality of symbol positions, the plurality of symbols occupying the symbol positions, each of the plurality of symbols selected from a set of available symbols, the set of available symbols including a plurality of standard symbols and at least one mystery symbol, the mystery symbol having a special functionality selected from a plurality of special functionalities and not included in any of the plurality of standard symbols;

detecting the presence of the at least one mystery symbol in at least one of the symbol positions in the array via one or more processors;

via the one or more processors, randomly selecting a first symbol from the plurality of standard symbols as a replacement symbol;

replacing all occurrences of the mystery symbol in the array with the replacement symbol to create a modified array via the one or more processors, wherein the replacement symbol has the same functionality as the mystery symbol; and providing the special functionality of the mystery symbol for all other occurrences of the first symbol in the plurality of symbols.

16. The computer readable storage medium of claim 15, wherein the special functionality is selected from the group consisting of wild symbol, scatter symbol, multiplier, multiplying wild symbol, expanding wild symbol, re-spin symbol, and symbol upgrade symbol.

17. The computer readable storage medium of claim 15, wherein the at least one mystery symbol includes a label associated with the special functionality.

18. The computer readable storage medium of claim 17, wherein the label is copied to each of the replacement symbols in the modified array.

19. The computer readable storage medium of claim 15, wherein the instructions further cause the act of evaluating the modified array for winning combinations of symbols in accordance with a pay table of the wagering game and awarding a prize for any winning combinations of symbols in the modified array in accordance with the pay table.

20. The computer readable storage medium of claim 15, wherein the plurality of symbols in the array are arranged on a plurality of rotatable reels.

21. The computer readable storage medium of claim 15, wherein the array comprises N symbol positions, wherein the number of symbol positions occupied by the at least one mystery symbol is less than N.

* * * * *

UNITED STATES PATENT AND TRADEMARK OFFICE

CERTIFICATE OF CORRECTION

PATENT NO. : 8,371,928 B2
APPLICATION NO. : 12/665255
DATED : February 12, 2013
INVENTOR(S) : Englman et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 475 days.

Signed and Sealed this
First Day of September, 2015

Michelle K. Lee

Michelle K. Lee
*Director of the United States Patent and Trademark Office*